United States Patent [19]

Stockman

[11] 4,149,587

[45] Apr. 17, 1979

[54] TORSION BAR SEAL ACTIVATING MEANS

[75] Inventor: Richard F. Stockman, Friendship, N.Y.

[73] Assignee: The Air Preheater Company, Inc., Wellsville, N.Y.

[21] Appl. No.: 902,643

[22] Filed: May 4, 1978

[51] Int. Cl.[2] ..... F28D 19/00

[52] U.S. Cl. ..... 165/9; 267/154

[58] Field of Search ..... 165/9; 267/154

[56] References Cited

U.S. PATENT DOCUMENTS 2,681,208 6/1954 Boestad et al. ..... 165/9

2,874,939 2/1959 Rahr et al. ..... 165/9

*Primary Examiner*—Albert W. Davis, Jr.

*Attorney, Agent, or Firm*—Wayne H. Lang

[57] ABSTRACT

A rotary regenerative air preheater including a housing surrounding a rotor of heat absorbent material that is adapted to rotate between a duct for heating fluid and a spaced duct that carries a fluid to be heated. Sealing means intermediate the rotor and the rotor housing include a torsion spring activated by the moving rotor that is adapted to bias the sealing means axially to provide a barrier that precludes fluid flow between the rotor and the rotor housing.

6 Claims, 6 Drawing Figures

TORSION BAR SEAL ACTIVATING MEANS

BACKGROUND OF THE INVENTION

The present invention relates to a rotary regenerative air preheater that includes a cylindrical rotor having a series of adjacent sector-shaped compartments that are mounted radially outward from a central rotor post. A rotor housing that surrounds the rotor is provided with spaced ducts for the axial flow of a heating fluid and of a fluid to be heated.

Due to a thermal gradient across the rotor there will be a differential of expansion effecting distortion that opens a gap permitting leakage between the rotor and the rotor housing. Spring biased sealing means that automatically adjust to close this gap and thus preclude leakage are commonly used. While such means may function in a satisfactory manner when first operational, they inherently corrode, collect deposits, and thus become ineffective in the hot environment to which they are subjected.

In designing springs for use in a hot air environment it has been found that the modulus of elasticity and the elastic limit are reduced with the increase of temperature, thereby lowering permissible stress. Therefore the design of springs used is dependent upon maintaining low design stress at elevated temperatures. It has also been found that the allowable stress used in the design of such apparatus may be increased approximately 75 percent by the use of torsion type springs instead of the compression or tension springs commonly used. This makes an arrangement utilizing a torsion bar type of spring extremely desirable, so it becomes the principal object of this invention to provide a radial seal for a rotary regenerative type air preheater that is biased into a sealing relationship by a torsion type spring.

The art contains various references showing radial sealing means that lie between the rotor and a surrounding rotor housing and are adapted to conform to a differential of expansion therebetween. U.S. Pat. No. 2,607,565 of Aug. 19, 1952, and U.S. Pat. No. 2,666,624 of Jan. 19, 1954, show a sealing means that is biased by an arrangement of coil springs, while U.S. Pat. No. 2,650,074 of Aug. 25, 1953, shows still another variation of a spring biased radial seal that utilizes a conventional spring.

In all the arrangements having a conventional coil or leaf spring, the spring action thereof rapidly degenerates whenever the spring is exposed to continuous heat, corrosion, or erosion.

SUMMARY OF THE INVENTION

This invention therefore provides for a specific seal biasing means for a rotary regenerative air preheater in which radial sealing means thereof are biased by an arrangement of torsion type springs that retain their effectiveness in various operational attitudes. The sealing means including the biasing arrangement therefor normally remains in an extended position until contact between relatively movable surfaces is made, whereupon a rubbing shoe forces the torsion bar to rotate so as to place a tension upon the bar, thus causing the seal to be biased axially in a manner that accommodates a differential of thermal expansion therebetween.

BRIEF DESCRIPTION OF THE DRAWING

The particular manner of operation will become more apparent from the specification and accompanying drawing in which.

DESCRIPTION OF THE PREFERRED EMBODIMENT

Figure 1:
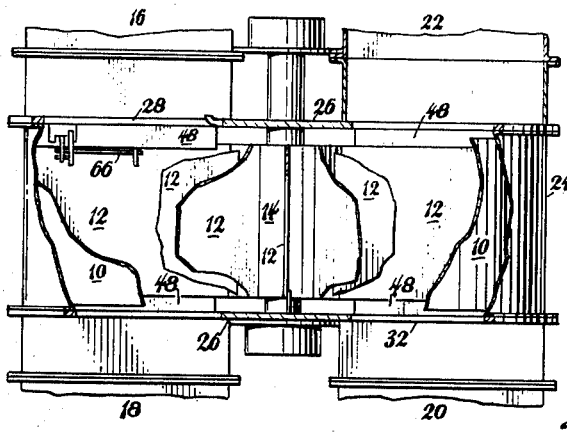
FIG. 1 is a side elevation of a rotary regenerative preheater, partially broken away.
Figure 2:
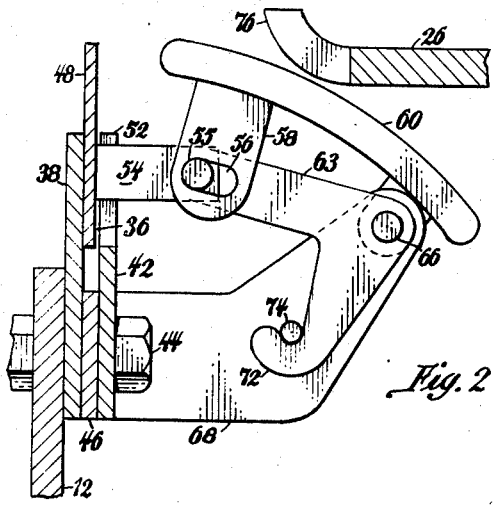
FIG. 2 is a cross-section of the seal and seal biasing means before contact with a seal actuator.

In the drawing the numeral 10 designates the cylindrical shell of a rotor that is divided into sector-shaped compartments by radial partitions 12 that extend outward from a central rotor post 14. The rotor compartments contain a mass of heat transfer material that first absorbs heat from hot gases entering the heat exchanger through a duct 16 from a boiler or other source of heat. After passing over the heat absorbent material of the rotor and transferring heat thereto, the then cooled gases are discharged through an outlet duct 18. As the rotor is turned slowly about its axis, the heated element is subjected to a stream of cool air entering at 20 and exhausted, after absorbing heat from the element, through an outlet duct 22.

A housing 24 encloses the rotor 10 and is provided at opposite ends thereof with end or sector plates 26 which include spaced apertures 28 and 32 through which the air and the gas are directed. p In order that the streams of air and gas do not bypass the heat absorbent element of the rotor by flowing through the clearance space between the end of the rotor and the adjacent sector plate, it is customary to provide radial seals 48 that are mounted on the ends of the diaphragms and adapted to wipe against the adjacent face of the sector plate 26 so as to seal off the spaces for gas and air at both ends of the rotor.

In order that the radial seals may be moved freely to engage the adjacent rotor housing, a radial slot 36 is first formed between radial support member 38 and a back-up plate 42, both of which are secured to the partition 12 by bolts 44. The slot 36 is formed of predetermined thickness by a shim 46 between plates 38 and 42 whereby the radial sealing member 48 of somewhat less thickness may be freely moved while it is provided with adequate lateral support. The back-up plate 42 is provided with a slot 52 through which one end of a clip 54 extends to serve as an actuator for the seal member 48. The clip 54 is rigidly secured to the sealing member 48 whereby vertical movement of the clip will produce a similar movement of the seal.

A pin 55 is secured to the clip 54 and adapted to extend perpendicularly therefrom a sufficient distance to engage opening 56 in adjacent actuator 58 for rocker actuator 60 and aligned opening 62 in the lever 63. The aligned openings in lever 63 and in the actuator 58 for the rocker 60 are elongated along a plane normal to movement of the sealing leaf 48 thereby permitting (vertical) movement of seal 48 and attached pin 55, while lever 63 and rocker 60 move circumferentially about the end of a torsion bar 66. Thus the seal 48 is moved in an axial direction while torsion bar 66 has one end thereof attached to a bracket 64 which is in turn fixed to the diaphragm or other rotor structure. The torsion bar 66 extends loosely through an opening 70 in a bracket 68 which is similar to bracket 64 and also carried by the rotor. The end of the torsion bar 66 lying adjacent the bracket 68 is attached to lever 63 which is pivotally linked to pin 55 by slot 62 whereby vertical movement of lever arm 63 will similarly move pin 55 and radial seal 48. When assembled it is of great importance that the end edge of seal 48 and the upper surface of rounded rocker 60 be maintained at the same elevation whereby the seal 48 will at no time extend above the rocker 60 to cause interference with the adjacent face of sector plate 26.

The radial sealing means 48 is thus adapted to rub against the plane under surface of sector plates 26. To preclude the sealing means 48 from being biased axially too far so that it will interfere with the leading edge of the sector plate, the rocker members 60 are attached to the torsion bar 66 and adapted to first come in contact with the underside of the sector plate 26 thereby actuating the sealing members 48 up or down the same distance as the rocker 60 is moved arcuately by the force exerted upon pin 55.

When the rotor is rotated so that a diaphragm and adjacent sealing means are moved out of contact with the face of an adjacent sector plate, the turning effect on torsion bar 66 will not be limited by the rocker 60 sliding in contact with the sector plate 26. Therefore the torsion bar will exert a turning force sufficient to move the lever arm 63 upward until stopped by the hooked end 72 on lever 63 moving into contact with stop means 74 on bracket 68.

Figure 3:
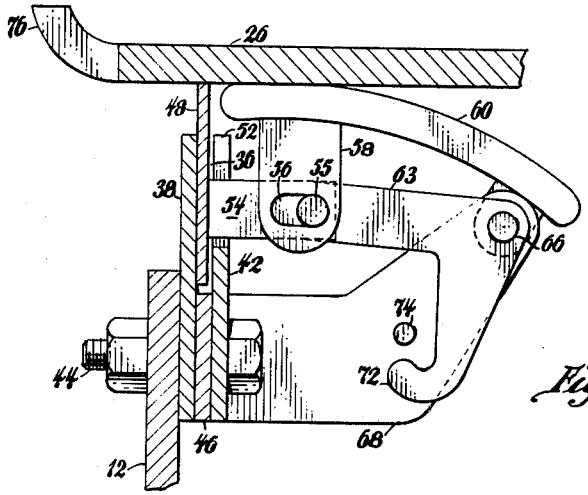
FIG. 3 is a cross-section of the seal and seal biasing means after contact with a seal actuator.
Figure 4:
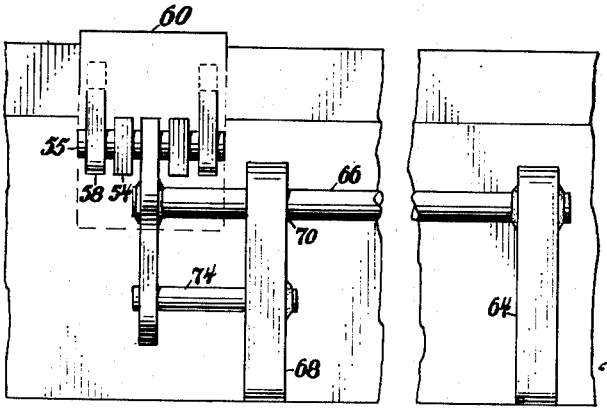
FIG. 4 is an enlarged view of the torsion bar seal shown in FIG. 1.
Figure 5:
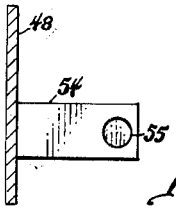
FIG. 5 is an enlarged view in cross-section of a radial seal and clip attached thereto.
Figure 6:
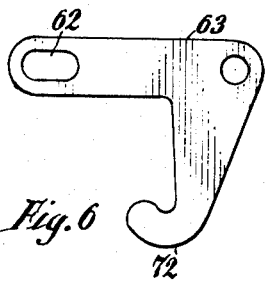
FIG. 6 is an enlarged view of the stop for limiting axial movement of the radial seal.

The leading edge of sector plate 26 is provided with a curved nose piece 76 that comes in sliding contact with rocker 60 when the rotor is rotated about its axis. As the rotor rotates, the rocker 60 moves from a position similar to that shown by FIG. 3 to that shown by the arrangement of FIG. 4. As the rocker 60 is turned down, it exerts a rotational effect upon the end of the torsion rod 66 to which it is attached. Inasmuch as the opposite end of rod 66 is firmly secured to the bracket 64, the rod is twisted so that a torsional force exerts a reverse or upwardly acting force upon the rocker 60 and seal member 48 which is pivotally attached thereto.

Inasmuch as rocker 60 slides against the surface of sector plate 26, the rocker 60 may be provided with a plastic coating, carbon inserts, or other means to reduce the frictional resistance therebetween. Similarly all materials used may be selected to best perform their assigned functions, and the apparatus may be otherwise modified to provide several actuators where only one is shown, or apparatus of a different size or shape, so long as they cooperate in the manner shown. It is thus to be understood that various changes may be made in the details of construction without departing from the spirit of the invention.

I claim:

1. Rotary regenerative heat exchange apparatus having a rotor including a central rotor post, a plurality of imperforate diaphragms connected to the rotor post and extending radially outward to provide a framework having a plurality of sector-shaped compartments between radial partitions, a rotor shell joining ends of the diaphragms to enclose the compartments, housing means surrounding the rotor shell, end plates at opposite ends of the rotor having imperforate sections between spaced openings that direct a heating fluid and a fluid to be heated axially through the compartments of the rotor, means for rotating the rotor about its axis to alternately align the compartments of the rotor with the heating fluid and with the fluid to be heated, heat absorbent element carried by each compartment of the rotor, radial sealing means movably mounted on each diaphragm and adapted to be moved axially into sealing relationship with the adjacent end plate to preclude flow between the heating fluid and the fluid to be heated, and a torsion bar adapted to axially bias said sealing means into contact with an adjacent end plate when the rotor is rotated about its axis.

2. Rotary regenerative heat exchange apparatus as defined in claim 1 wherein said torsion bar lies substantially parallel to the sealing means.

3. Rotary regenerative heat exchange apparatus as defined in claim 2 wherein one end of the torsion bar is rigidly secured to the rotor and the other end thereof is secured to the movable sealing means.

4. Rotary regenerative heat exchange apparatus as defined in claim 3 including a rocker arm secured to one end of said torsion bar adapted to rotate when it comes in contact with an adjacent end plate whereby said rocker arm will rotate and twist the torsion bar to effect axial movement of the radial seal.

5. Rotary regenerative heat exchange apparatus as defined in claim 4 including a curved nose piece contiguous with the sector plate and adapted to contact the rocker arm for the torsion bar when the rotor is rotated about its axis.

6. Rotary regenerative heat exchange apparatus as defined in claim 5 wherein the curved nose piece is contiguous with the leading edge of the sector plate to provide primary contact with the rocker arm when the rotor is rotated about its axis.

* * * * *